US006929595B2

(12) United States Patent
Shimizu

(10) Patent No.: US 6,929,595 B2
(45) Date of Patent: Aug. 16, 2005

(54) PRINTING SYSTEM, CONTROLLER, PRINTING METHOD AND STORAGE MEDIUM

(75) Inventor: Katsuhisa Shimizu, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 10/639,590

(22) Filed: Aug. 13, 2003

(65) Prior Publication Data

US 2004/0190065 A1 Sep. 30, 2004

(30) Foreign Application Priority Data

Aug. 14, 2002 (JP) ..... P2002-236213

(51) Int. Cl.[7] ..... B31B 1/88
(52) U.S. Cl. ..... 493/320; 493/323
(58) Field of Search ..... 493/320, 321, 493/322, 323; 270/52.08, 52.14, 52.18

(56) References Cited

U.S. PATENT DOCUMENTS 4,900,001 A * 2/1990 Lapeyre ..... 270/1.01
5,905,935 A * 5/1999 Wakamatsu et al. ..... 399/407
6,339,685 B1 * 1/2002 Okamoto et al. ..... 399/16
6,570,665 B1 * 5/2003 Niv et al. ..... 358/1.13

FOREIGN PATENT DOCUMENTS

JP P2000-289299 A 10/2000
JP P2001-209518 A 8/2001
JP P2002-36669 A 2/2002

* cited by examiner

*Primary Examiner*—Eugene Kim
(74) *Attorney, Agent, or Firm*—McDermott Will & Emery LLP

(57) ABSTRACT

A controller of a printing system creates imposed printing data in which a plurality of printing data for representing a printing image on one side of a sheet printed) are imposed (i.e., data to represent printing images covering a single page of a printed matter). The controller also determines a sequence of output of imposed printing data with respect to a printing apparatus, on the basis of information about pickup of sheets in a bookbinding apparatus, and the controller then outputs the imposed printing data to the printing apparatus in a sequence of output so determined. The printing apparatus prints on the sheets printing images represented by the imposed printing data, in accordance with the sequence inputted from the controller. The sheets printed by the printing apparatus are then picked up and bound. This eliminates that any operator is required to impose a plurality of printing data in consideration of the pickup of sheets in the bookbinding apparatus. It is therefore possible to provide a printing system that does not require any operator to have such a skill.

6 Claims, 8 Drawing Sheets

| | |
|---|---|
| NUMBER OF PAGES | 8 |
| PERFECTING | ON |
| NUMBER OF FOLDING | 1 |
| DIRECTION OF FOLDING | RIGHT |
| STITCHING METHOD | SADDLE STITCHING |
| OFFSET | 5.5 (mm) |

| MRPD1 | |
|---|---|
| RPD8 | OFFSET (5, 5) |
| RPD1 | OFFSET (Oh+5, 5) |

| MRPD2 | |
|---|---|
| RPD2 | OFFSET (5, 5) |
| RPD7 | OFFSET (Oh+5, 5) |

| MRPD3 | |
|---|---|
| RPD6 | OFFSET (5, 5) |
| RPD3 | OFFSET (Oh+5, 5) |

| MRPD4 | |
|---|---|
| RPD4 | OFFSET (5, 5) |
| RPD5 | OFFSET (Oh+5, 5) |

FIG. 15
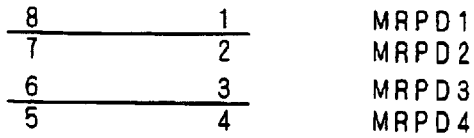
FIG. 16
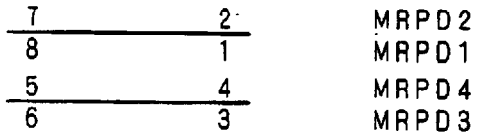
FIG. 17
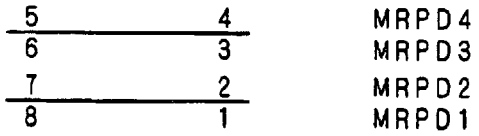
FIG. 18
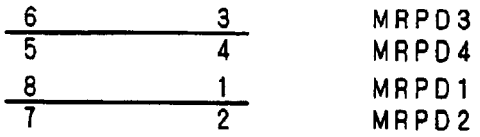
FIG. 19
| SEQUENCE OF OUTPUT | IMPOSED PRINTING DATA |
|---|---|
| 1 | MRPD4 |
| 2 | MRPD3 |
| 3 | MRPD2 |
| 4 | MRPD1 |
OPS

PRINTING SYSTEM, CONTROLLER, PRINTING METHOD AND STORAGE MEDIUM

BACKGROUND OF THE INVENTION

1. Field of the Invention

The present invention relates to a technique of executing efficiently bookbinding operation with a bookbinding apparatus in a printing system that has a printing apparatus to which the bookbinding apparatus is connected, and a controller that supplies printing data to the printing apparatus and causes it to execute printing.

2. Description of the Background Art

In recent years, there has come in practice a digital printing apparatus that can directly print on a sheet printing data created by a desktop publishing application running on a computer in general use, without passing through a plate making step. There is also being developed such a printing system that performs consistently from page data creation to bookbinding by directly connecting a bookbinding apparatus to such a digital printing apparatus and sending a printed sheet delivered from the digital printing apparatus into the bookbinding apparatus.

On the other hand, in general printing, a plurality of printing images represented by printing data are imposed on one side of a sheet in consideration of stitching. Also in the digital printing apparatus, it is preferable to execute such imposition prior to printing.

There is however the problem that when a bookbinding apparatus is connected to a digital printing apparatus, the printing apparatus is required to execute imposition in consideration of a sequence in which the bookbinding apparatus picks up sheets.

It is now proposed to consider a particular case of printing a document consisting of eight pages on two sheets Pa and Pb, for example, assuming that a direction of folding is "left-hand opening" and the setting of stitching is "saddle stitching." In this case, page 8 and page 1 are imposed on the top side of sheet Pa, page 2 and page 7 are imposed on the back side of sheet Pa, page 6 and page 3 are imposed on the top side of sheet Pb, and page 4 and page 5 are imposed on the back side of sheet Pb. The digital printing apparatus delivers sheets Pa and Pb on which the printing images represented by their respective printing data are imposed. At this time, the printing apparatus stacks the sheets such that an earlier printed sheet is located at a lower position. Therefore, if the bookbinding apparatus picks up sheets from the lowermost position of the stacked sheets, the bookbinding apparatus picks up sheet Pa and Pb in the order named, thereby obtaining the document arranged in the correct sequence.

However, if the bookbinding apparatus picks up sheets from the uppermost position of the stacked sheets, the bookbinding apparatus picks up sheet Pb and Pa in the order named, thereby failing to obtain the document arranged in the sequence. Therefore, if the bookbinding apparatus picks up sheets from the uppermost position of the stacked sheets, an operator of the digital printing apparatus is required to impose page 6 and page 3 on the top side of sheet Pa, page 4 and page 5 on the back side of sheet Pa, page 8 and page 1 on the top side of sheet Pb, and page 2 and page 7 on the back side of sheet Pb.

This causes the problem that an operator of the digital printing apparatus cannot perform imposition unless the operator is well acquainted with the sequence in which the bookbinding apparatus connected to the digital printing apparatus picks up sheets.

SUMMARY OF THE INVENTION

The present invention is directed to a technique of executing efficiently bookbinding operation in a bookbinding apparatus in a printing system that has a printing apparatus to which the bookbinding apparatus is connected, and a controller that supplies printing data to the printing apparatus and causes it to execute printing.

According to the present invention, a printing system includes a printing apparatus, bookbinding apparatus and controller. The printing apparatus prints on sheets imposed printing data in which printing data are imposed. The bookbinding apparatus is coupled to the printing apparatus and binds sheets on which the imposed printing data are printed by the printing apparatus. The controller supplies the printing data to the printing apparatus. The controller includes a storage element, information capture element, setting element, sequence determination element and output element. The storage element stores printing data. The information capture element captures information about pickup of sheets in the bookbinding apparatus, as a bookbinding apparatus setting information. The setting element sets information for imposing on sheets the printing data stored in the storage element, as an imposition information. The sequence determination element creates the imposed printing data on the basis of the printing data while referring to the bookbinding apparatus setting information captured by the information capture element and the imposition information set by the setting element, and also determines a sequence of output of the imposed printing data so created. The output element outputs the imposed printing data to the printing apparatus in the sequence of output determined by the sequence determination element. Thereby, the printing apparatus prints on the sheets the imposed printing data in a sequence outputted by the output element and then supplies them to the bookbinding apparatus.

With this configuration, it is not necessary for an operator to impose printing data in consideration of the pickup of sheets in the bookbinding apparatus.

Accordingly, it is an object of the present invention to provide a printing system that does not require any operator's skill for imposition in consideration of the pickup of sheets in a bookbinding apparatus.

These and other objects, features, aspects and advantages of the present invention will become more apparent from the following detailed description of the present invention when taken in conjunction with the accompanying drawings.

BRIEF DESCRIPTION OF THE DRAWINGS

FIG. 15 is a diagram showing a sheet stacking state required when a bookbinding part picks up sheets in "the uppermost position" and "face up";

FIG. 16 is a diagram showing a sheet stacking state required when the bookbinding part picks up sheets in "the uppermost position" and "face down";

FIG. 17 is a diagram showing a sheet stacking state required when the bookbinding part picks up sheets in "the lowermost position" and "face down";

FIG. 18 is a diagram showing the sheet stacking state required when a bookbinding part picks up sheets in "the lowermost position" and "face up"; and FIG. 19 is a diagram showing an imposed-printing-data output sequence table OPS in the example illustrated in FIG. 15.

DESCRIPTION OF THE PREFERRED EMBODIMENTS

Figure 1:
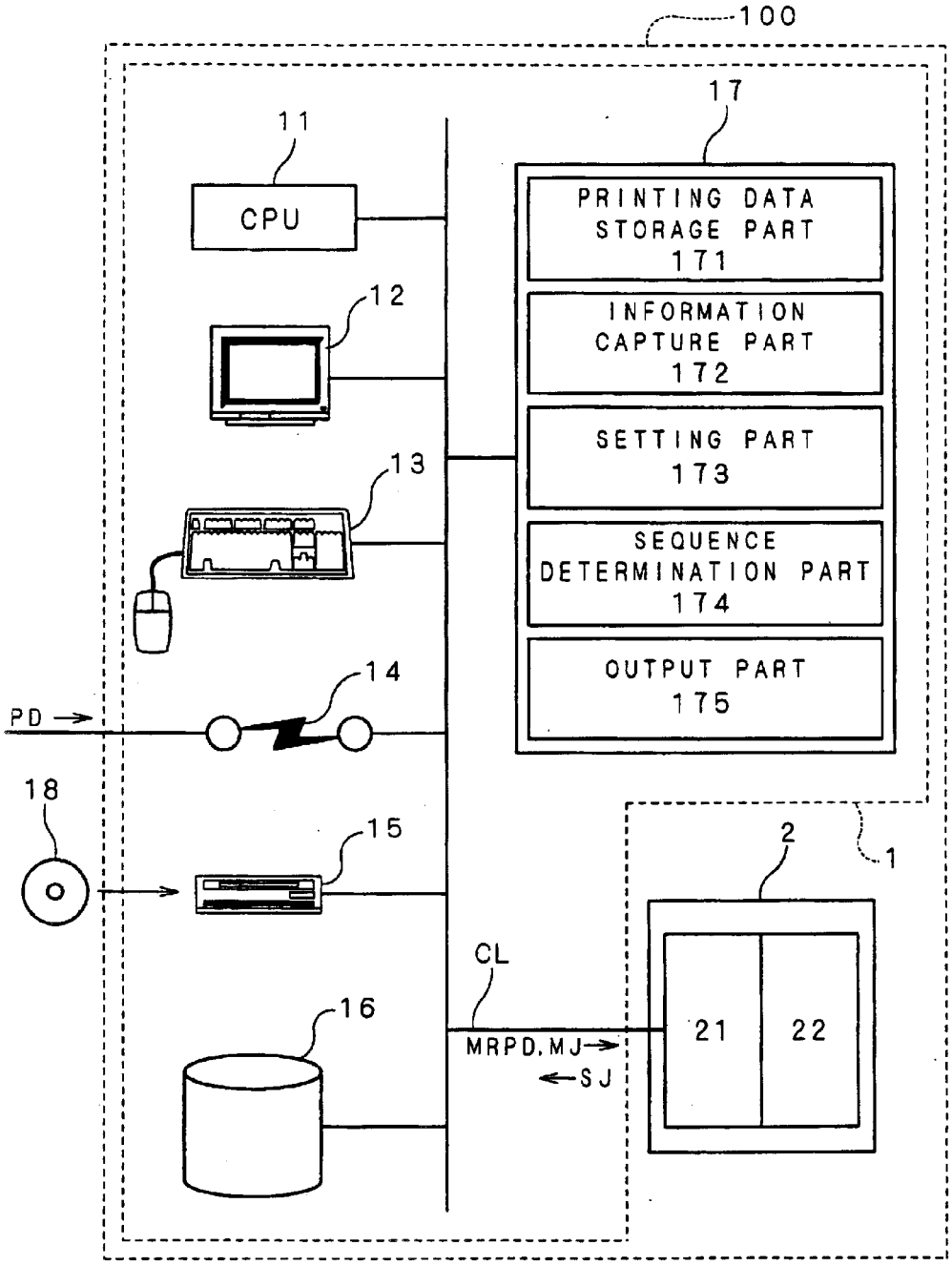
FIG. 1 is a diagram showing the configuration of a printing system according to one preferred embodiment of the present invention.

FIG. 1 shows the configuration of a printing system 100 that is one preferred embodiment of the present invention. The printing system 100 comprises mainly a controller 1, communication line CL and printing apparatus 2.

The controller 1 is a device that has approximately the same configuration as a general personal computer, and consists of a CPU 11, display part 12, input part 13, network interface 14, media drive 15, storage part 16 and memory 17.

The CPU 11 controls the whole of the controller 1 and, in particular, implements the function of the controller 1 by executing in the memory 17 a program stored in a media disk 18 inserted in the media drive 15. The display part 12 displays information necessary for a process in the controller 1. The input part 13 is, for example, composed of a mouse and keyboard, and accepts an operator's instructions to the controller 1.

The network interface 14 is used to connect the controller 1 and a network (not shown). The controller 1 receives, via the network interface 14, page data PD from a terminal (not shown) connected to the network. The term "page data PD" means data corresponding to a single printed matter that is bound by a bookbinding part 22 to be described hereinafter.

The controller 1 in this preferred embodiment receives page data PD from the above-mentioned terminal and creates printing data RPD from the received page data PD, as noted in detail hereinafter. Alternatively, the controller 1 may receive printing data RPD from the above-mentioned terminal. The term "printing data RPD" means data individually represent a single page in a printed matter. Since a printed matter to be bound by the bookbinding part 22 has generally a plurality of pages, even for a single printed matter, a plurality of printing data RPD are created from a single page data PD.

The media drive 15 is a device for reading a program recorded in the media disk 18. As stated above, the CPU 11 executes the program read by the media drive 15 so that the function of the controller 1 is implemented. The program read by the media drive 15 is then stored in the storage part 16. The program for implementing the function of the controller 1 may be downloaded, via the network interface 14, from a server (not shown) connected to the network.

The communication line CL interconnects the controller 1 and printing apparatus 2 so as to enable data communication therebetween. For example, the controller 1 sends imposed printing data MRPD and imposition information MJ to the printing apparatus 2 via the communication line CL, as noted in detail hereinafter. The term "imposed printing data MRPD" means data which is represented in such a format that a printing image represented by a predetermined number of printing data RPD is arranged according to a predetermined rule (hereinafter referred to as an "imposition rule"), and which covers one side of a sheet to be printed by the printing part 21. Specifically, when the printing part 21 performs perfecting, two imposed printing data MRPD are used to a single sheet. In the case of single-sided printing, one imposed printing data MRPD is used to a single sheet. When four pages of a printed matter are imposed on one side of a sheet, one imposed printing data MRPD is created from four printing data RPD. In an alternative, the controller 1 and printing apparatus 2 may be connected through the network interface 14 to a network (not shown).

The printing apparatus 2 has the printing part 21 and bookbinding part 22. The printing apparatus 2 is connected via the communication line CL to the controller 1 so as to enable data communication therebetween, and it sends bookbinding apparatus setting information SJ to the controller 1. The term "bookbinding apparatus setting information SJ" is information that is related to a sheet pickup manner of the bookbinding part 22, and that the controller 1 uses to determined a sequence of printing in the printing part 21. This will be fully described hereinafter by using FIG. 3. Although in the printing system 100 of this preferred embodiment a single printing apparatus 2 is connected to the controller 1, a plurality of printing apparatuses 2 may be connected thereto.

The printing part 21 prints on one side of each sheet an image represented by an imposed printing data MRPD sent from the controller 1, in accordance with the sequence sent from the controller 1. Specifically, when two imposed printing data MRPD are sent from the controller 1 and these data are subjected to perfecting, the printing part 21 prints the first received imposed printing data MRPD on the back side of a sheet (a plane facing down at the time of delivery) and then prints the next following imposed printing data MRPD on the top side of the sheet (a plane facing up at the time of delivery). The sheets so printed are then delivered in such a state that the succeeding printed sheet is stacked on the preceding printed sheet. As a printing method of the printing part 21, electrophotography method, ink jet method and offset method, etc. are usable.

The bookbinding part 22 picks up sheets after being subjected to printing in the printing part 21, and binds them by stitching. The bookbinding part 22 performs binding on the basis of the setting of imposition information MJ to be described hereinafter. The bookbinding part 22 picks up sheets sequentially from the top or bottom of a plurality of sheets that are printed and then stacked by the printing part 21. The printing apparatus 2 sends information about a pickup manner as a bookbinding apparatus setting information SJ, to the controller 1 via the communication line CL. Although the printing apparatus 2 of this preferred embodiment has only one bookbinding part 22, it may be configured, for example, such that a plurality of bookbinding parts 22 are alternatively connected to the printing part 21.

The memory 17 is a work area at which the CPU 11 executes a program stored in the storage part 16. The execution of the program by the CPU 11 causes the memory 17 to implement the functions of a printing data storage part 171, information capture part 172, setting part 173, sequence determination part 174 and output part 175.

The printing data storage part 171 is used to store a plurality of printing data RPD. In this preferred embodiment, the file format of the printing data RPD are of bit map. Without limiting to the bit map format, it may be of TIFF format. The printing data storage part 171 also has the function of storing imposed printing data MRPD that is created in a process to be described hereinafter.

The information capture part 172 captures and stores bookbinding apparatus setting information SJ sent from the printing apparatus 2. The bookbinding apparatus setting information SJ captured by the information capture part 172 is used in an output sequence determination process of imposed printing data MRPD in the sequence determination part 174 to be described hereinafter. In an alternative, an operator of the controller 1 may input bookbinding apparatus setting information SJ by using the input part 13.

The setting part 173 sets information about imposition to sheets, which is performed in a printing process of printing data RPD. That is, based on the information inputted by the operator operating the input part 13, imposition information MJ describing information about an imposition rule for creating printing data MRPD is created from the printing data RPD. Specific contents of the imposition information MJ will be described by referring to FIG. 4. The imposition information MJ is used in a process for creating imposed printing data MRPD and a process for determining a sequence of output of the imposed printing data MRPD in the sequence determination part 174, which are to be described hereinafter.

The setting part 173 sends imposition information MJ via the communication line CL to the bookbinding part 22 (printing apparatus 2). Thus, the imposition information MJ is referred to in a process for binding sheets in the printing part 22 (the details will be described hereinafter).

The sequence determination part 174 creates imposed printing data MRPD on the basis of imposition information MJ. The sequence determination part 174 also determines, when sending a plurality of imposed printing data MRPD to the printing apparatus 2, the sequence of output of these imposed printing data MRPD on the basis of bookbinding apparatus setting information SJ. As stated above, the printing apparatus 2 cannot provide efficient bookbinding process unless the printing part 21 stacks sheets in accordance with the pickup of sheets in the bookbinding part 22. When printing a plurality of sheets, the printing part 21 stacks the sheets in such a state that a later printed sheet is stacked on an earlier printed sheet. That is, the printing part 21 of the printing apparatus 2 prints imposed printing data MRPD in the sequence received, and a sheet stacking state is determined by the sequence in which the printing part 21 performs printing. In order to enable printing corresponding to the sheet pickup of the bookbinding part 22, the sequence determination part 174 determines a sequence in which imposed printing data MRPD are outputted to the printing apparatus 2.

The output part 175 outputs respective imposed printing data MRPD to the printing apparatus 2 in the sequence determined by the sequence determination part 174. The imposed printing data MRPD are sent to the printing apparatus 2 via the communication line CL. Thus, the printing part 21 of the printing apparatus 2 prints on sheets printing image represented by the imposed printing data MRPD in the sequence received, and the bookbinding part 22 performs a folding process and stitching process for bookbinding on the basis of the setting of imposition information MJ, while picking up the sheets stacked by the printing part 21.

Figure 2:
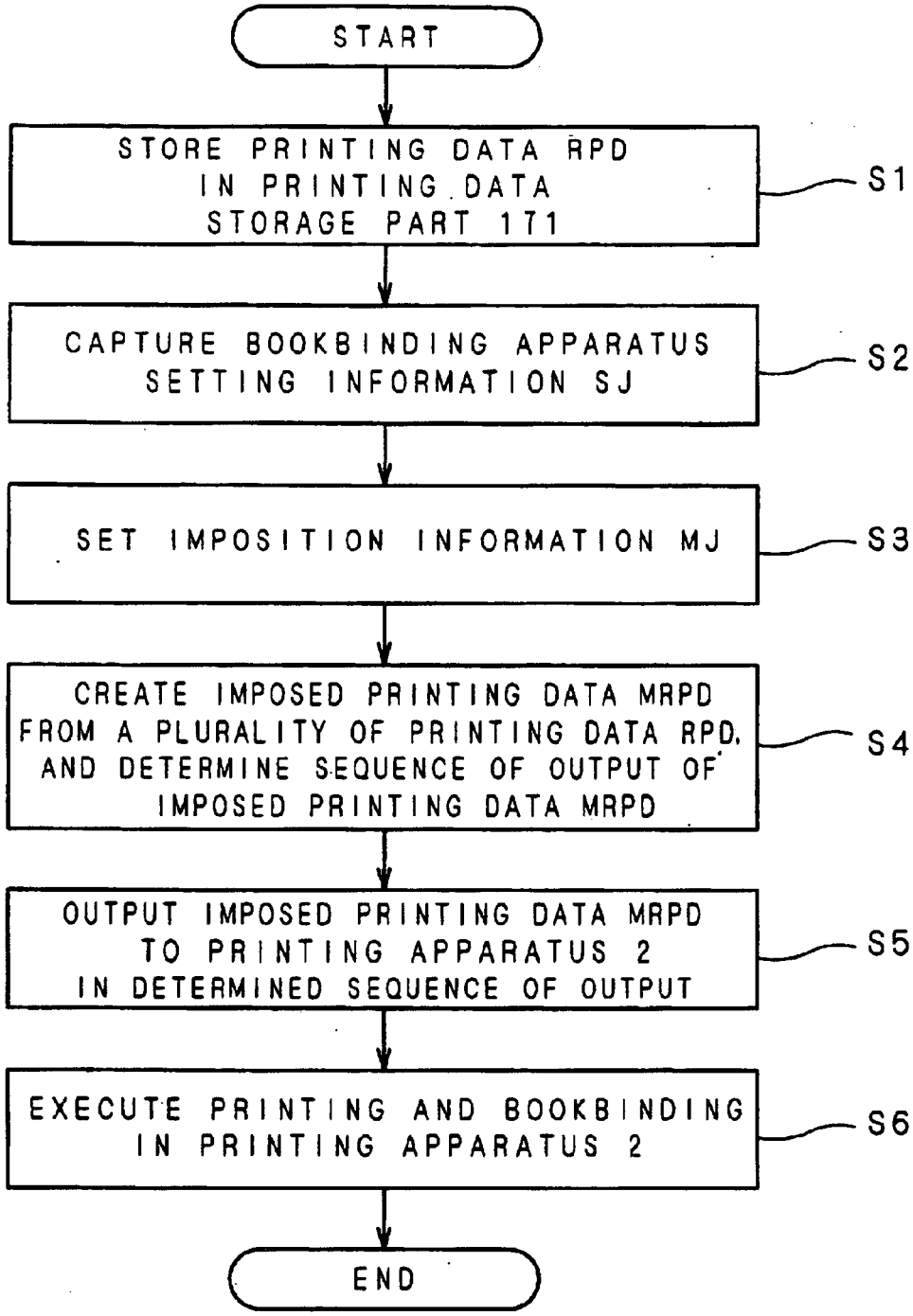
FIG. 2 is a flowchart showing the operation of the printing system.

FIG. 2 is a flowchart to explain the operation of the printing system 100.

In step S1, the controller 1 performs rasterization of page data PD received from the terminal with the use of the function of a raster image processor (not shown), thereby creating printing data RPD that represents a printing image by binarized data. Hereat, page data PD is data that has a format, for example, page description language such as PostScript (registered trademark of Adobe Systems Incorporated, USA) and PDF (portable document format), and that is created in a terminal (not shown) connected via the network in order to produce a printing matter having a plurality of pages. In the printing system 100, page data PD is rasterized in step S1 thereby to create a plurality of printing data RPD representing printing images for one page. The printing data RPD so created are then stored in the printing data storage part 171.

In step S2, the information capture part 172 of the controller 1 captures bookbinding apparatus setting information SJ that is sent via the communication line CL from the bookbinding part 22 of the printing apparatus 2. The bookbinding apparatus setting information SJ is information about a sheet pickup manner of the bookbinding part 22, which indicates the sequence of pickup and its pickup state when the bookbinding part 22 picks up sheets. Specifically, the information about the sequence of pickup indicates the sequence in which the bookbinding part 22 picks up sheets, and the information about the pickup state indicates whether the bookbinding part 22 picks up sheets with the top side facing up or down.

FIG. 3 to FIG. 6 are diagrams to explain the pickup of sheets in the bookbinding part 22. In this preferred embodiment, the sequence of pickup can be classified into two types of "the uppermost position" and "the lowermost position, and the pickup state can be classified into two types of "face up" and "face down".

Figure 3:
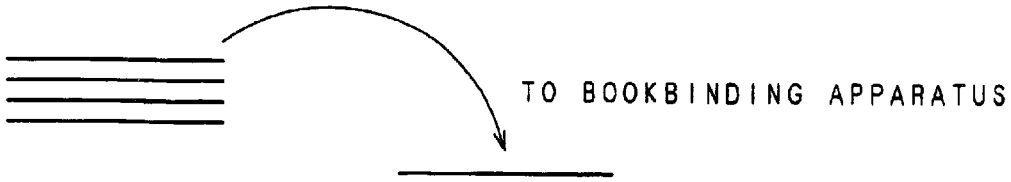
FIG. 3 is a diagram showing the situation that the a bookbinding part picks up sheets from "the uppermost position"

Specifically, "the uppermost position" in the sequence of pickup means, as shown in FIG. 3, that the bookbinding part 22 picks up sheets sequentially from a sheet that is located at the uppermost position of stacked sheets.

Figure 4:
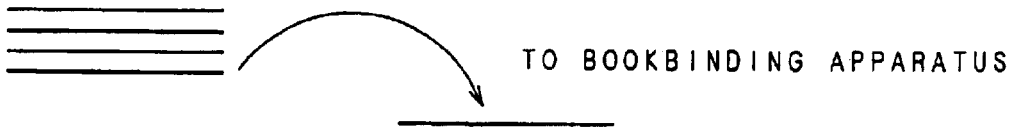
FIG. 4 is a diagram showing the situation that the bookbinding part picks up sheet from the "lowermost position"

In contrast, "the lowermost position" means, as shown in FIG. 4, that the bookbinding part 22 picks up sheets sequentially from a sheet that is located at the lowermost position of the stacked sheets.

Figure 5:
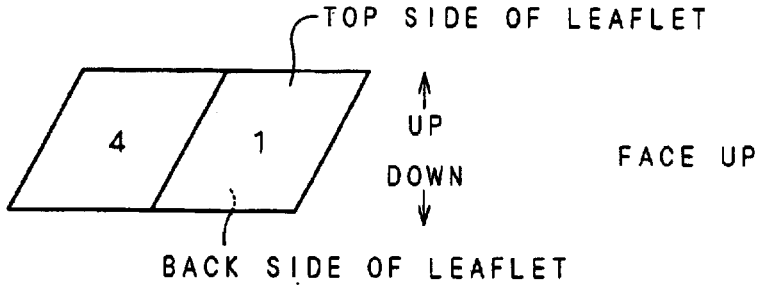
FIG. 5 is a diagram of a leaflet with its top side facing up.

In the case that the bookbinding part 22 produces a leaflet of four pages by folding a single sheet, the "face up" in the pickup state means, as shown in FIG. 5, that the bookbinding part 22 picks up the sheet with its one side facing up, on which printed are page 1 and page 4 that are the top side of the leaflet.

Figure 6:
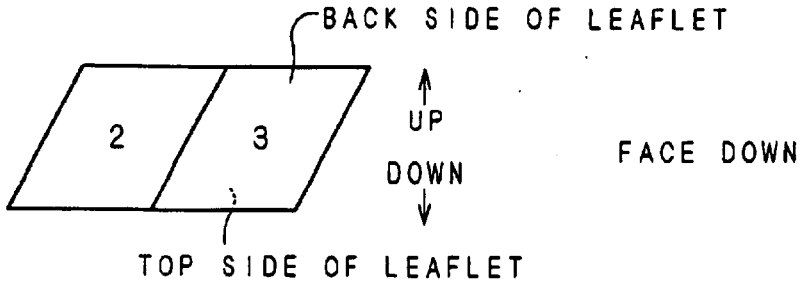
FIG. 6 is a diagram of the leaflet with its back side facing up.

On the other hand, the "face down" of the pickup state means, as shown in FIG. 6, that the bookbinding part 22 picks up the sheet with its one side facing down, on which there are printed page 1 and page 4 that are the top side of the leaflet.

Therefore, the bookbinding apparatus setting information SJ that the information capture part 172 captures from the bookbinding part 22 is information about a sheet pickup manner that is indicated by a combination of "the uppermost position" or "the lowermost position" and "face up" or "face down". The information capture part 172 stores temporarily the bookbinding apparatus setting information SJ captured from the bookbinding part 22, in order to use it in a process for determining the sequence of output of imposed printing data MRPD to be described hereinafter.

In step S3, the setting part 173 sets imposition information MJ for producing a printed matter. That is, the setting part 173 sets imposition information MJ on the basis of information that is inputted by the operator operating the input part 13.

Figures 7, 8:
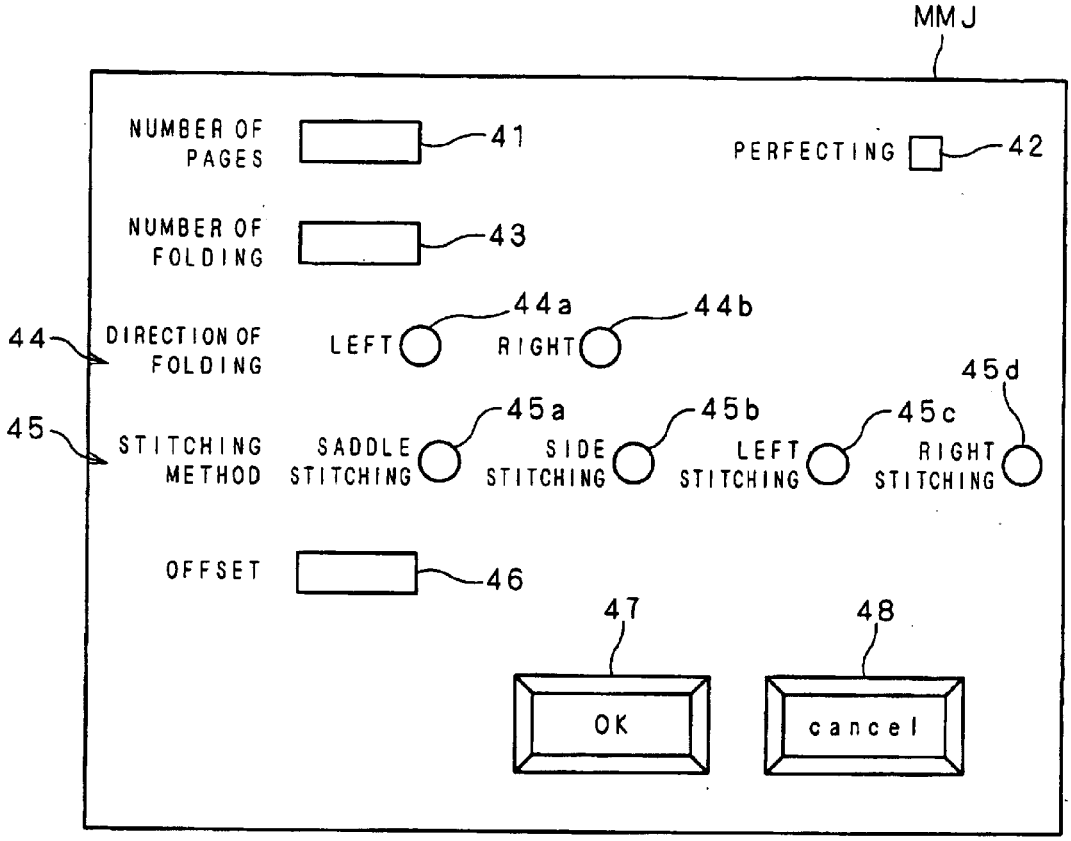
FIG. 7 is a diagram showing the configuration of an imposition information setting menu MMJ.
FIG. 8 is a diagram showing the configuration of imposition information MJ.

FIG. 7 shows the configuration of an imposition information setting menu MMJ that the setting part 173 displays on the display part 12 in order to set imposition information MJ. The operator may operate the input part 13 to input information necessary for this imposition information setting menu MMJ. Based on the information so inputted, the setting part 173 sets imposition information MJ. The following is a concrete explanation.

Imposition information setting menu MMJ includes a page number input column 41, perfecting designation column 42, folding number input column 43, folding direction designation column 44, stitching method designation column 45, offset input column 46, OK button 47 and cancel button 48.

The page number input column 41 is used to input the number of pages of a printed matter to be produced (corresponding to the number of printing data RPD). The number of pages that the imposition information setting menu MMJ initially displays on the page number input column 41 corresponds to the number of printing data RPD stored in the printing data storage part 171. If the number of pages printed is otherwise designated separately, the operator can operate the input part 13 to input the desired number of pages in the page number input column 41.

The perfecting designation column 42 is used to designate whether perfecting of sheets is executed or not. When the operator operates the input part 13 to check a check box of the perfecting designation column 42, the controller 1 sends an instruction of printing on both sides of a single sheet to the printing apparatus 2 via the communication line CL.

The printing part 21 of the printing apparatus 2 receives this instruction and prints on both sides of a sheet a printing image represented by two imposed printing data MRPD sent from the controller 1.

If the printing part 21 of the printing apparatus 2 performs only single-sided printing, the setting part 173 may be configured so as not to accept any input to the perfecting designation column 42.

The folding number input column 43 is used to input a desired folding number for binding a printed matter. Based on the folding number inputted in the folding number input column 43, the setting part 173 sets the number of printing data RPD used for imposed printing data MRPD.

The number of folding relates to the number of pages to be printed on a single sheet. For example, when the number of folding to a single sheet is "1", a total of four pages are printed on both sides of the sheet. When the folding number is "2", a total of eight pages are printed on both sides of the sheet. In this fashion, the number of pages that is obtained by multiplying the number of folding by 4 is to be printed on both sides of a single sheet.

Accordingly, when the number of folding is inputted in the folding number input column 43, the setting part 173 sets imposition information MJ, assuming that printing data RPD of the number of "4×(the number of folding)" are used to create imposed printing data MRPD. When the number of folding of "1" or more is inputted in the folding number input column 43, the setting part 173 performs setting of imposition information MJ, assuming that perfecting is performed in the printing part 21 of the printing apparatus 2.

The folding direction designation column 44 is used to designate a desired direction in which the pages of a printed matter are opened (i.e., a direction of opening). The column 44 is therefore provided with a left-hand opening button 44*a* and right-hand opening button 44*b*.

Specifically, the correct page sequence of a completed printed matter is obtainable by designating a direction of opening. For example, in the case of "left-hand opening", the pages of a printed matter are arranged in the correct sequence when they are opened to the left. Whereas in the case of "right-hand opening", the pages of a printed matter are arranged in the correct sequence when they are opened to the right.

The operator may operate the input part 13 to select the left-hand opening button 44*a* or right-hand opening button 44*b*. When the left-hand opening button 44*a* is selected, the setting part 173 sets imposition information MJ by taking the desired direction of opening as "left-hand opening". When the right-hand opening button 44*b* is selected, the setting part 173 sets imposition information MJ by taking the desired direction of opening as "right-hand opening".

Note that the left-hand and right-hand opening buttons 44*a* and 44*b* in the folding direction designation column 44 cannot be selected concurrently due to the nature of the folding direction.

The stitching method designation column 45 is used to designate a desired stitching method of a printed matter. The stitching method designation column 45 is therefore provided with a saddle stitching designation button 45*a*, side stitching designation button 45*b*, left stitching designation button 45*c* and right stitching designation button 45*d*.

The stitching method is related to a stitching process for binding a desired printed matter. For example, in bookbinding with saddle stitching, a wire for stitching is passed through a middle part of a printed matter composed of two pages and the middle part is then folded. When binding with side stitching, a wire for stitching is passed through, or a thread stitching is performed to, or adhesive is applied to a location opposed to a side on which a printed matter is opened in the state that a plurality of printed sheets after being subjected to folding are stacked with each other.

The operator may operate the input part 13 to select the saddle stitching designation button 45*a* or the side stitching designation button 45*b*. If the button 45*a* is selected, the setting part 173 sets imposition information MJ by taking that the stitching method used for bookbinding in the bookbinding part 22 of the printing apparatus 2 is "saddle stitching". If the button 45*b* is selected, the setting part 173 sets imposition information MJ by taking it as "side stitching".

Alternatively, when designating a stitching of a printed matter to which no folding is performed, the operator may operate the left stitching designation button 45*c* or right stitching designation button 45*d*. Thereby, the setting part 173 sets imposition information MJ taking the stitching method employed by the bookbinding part 22, as a method of stitching the left or right end of sheets.

Note that the saddle stitching designation button 45*a*, side stitching designation button 45*b*, left stitching designation button 45*c* and right stitching designation button 45*d* cannot be selected concurrently.

The offset input column 46 is used to set a position on a sheet at which a printing image represented by a plurality of printing data RPD is placed. The operator may operate the input part 13 to input an offset value from the origin that is the lower left corner of the sheet. The offset value so inputted may be in any unit such as mm (millimeter) and the number of pixels. Then, the setting part 173 sets imposition information MJ taking that the lower left corner of the printing image represented by printing data RPD is located at the position designated by the inputted offset value.

In the case that the number of folding is already inputted, a printing image represented by a plurality of printing data RPD constituting imposed printing data MRPD is to be printed on a sheet. In this case, the position of the printing image represented by the printing data RPD is found from a folding position and an offset value (to be described in detail).

When the inputs to the imposition information setting menu MMJ are satisfactory, the operator may operate the input part 13 to select the OK button 47. Upon this, the setting part 173 determines the setting of imposition information MJ on the basis of the inputs executed to the imposition information setting menu MMJ, and discontinues the display of the imposition information setting menu MMJ. On the other hand, when the inputs to the imposition information setting menu MMJ are unsatisfactory, the operator may select the cancel button 48. Upon the selection of the cancel button 48, the setting part 173 discontinues the display of the imposition information setting menu MMJ, without determining the setting of imposition information MJ.

FIG. 8 shows the configuration of imposition information MJ. On the imposition information setting menu MMJ, an operator executes the following inputs, for example, "8" in the page number input column 41, no designation in the perfecting designation column 42, "1" in the folding number input column 43, "right direction" in the folding direction designation column 44, "saddle stitching" in the stitching method designation column 45, and "5 mm, 5 mm" in the offset input column 46. As the result, the setting part 173 sets imposition information MJ as shown in FIG. 8. That is, the imposition information MJ are set as follows: (i) the number of pages is "8", (ii) "on" is automatically set to the perfecting because "1" is inputted as the number of folding, (iii) the number of folding is "1", (iv) the direction of folding is "right", (v) the stitching method is "saddle stitching", and the offset value is "5 mm, 5 mm".

The setting part 173 stores temporarily the imposition information MJ so set, and also sends it to the printing apparatus 2 via the communication line CL. In a process to be described, based on the setting of the imposition information MJ, the printing apparatus 2 executes perfecting in the printing part 21, and the folding process and stitching process in the bookbinding part 22.

In step S4, based on the bookbinding apparatus setting information SJ captured by the information capture part 172 and the imposition information MJ set by the setting part 173, the sequence determination part 174 creates imposed printing data MRPD from the printing data RPD stored in the printing data storage part 171, and then determines the sequence of output of the imposed printing data MRPD.

Figure 9:
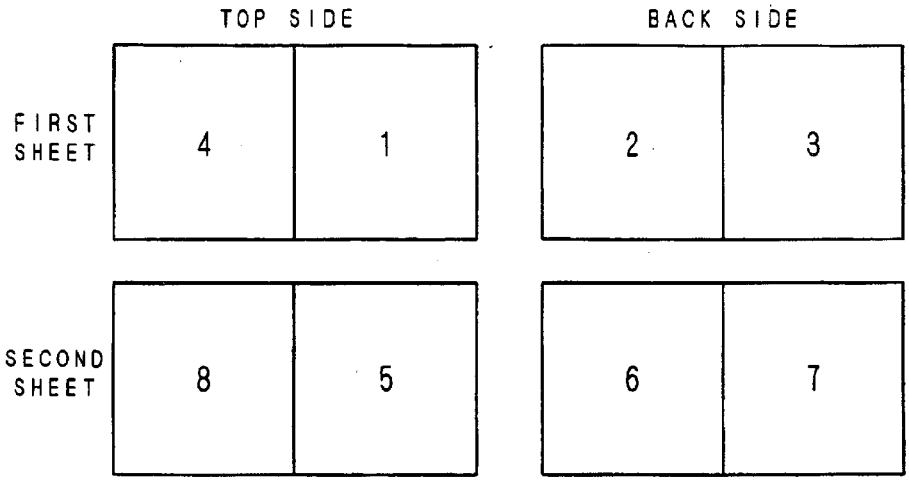
FIG. 9 is a diagram to explain imposition in the case of side stitching.
Figure 10:
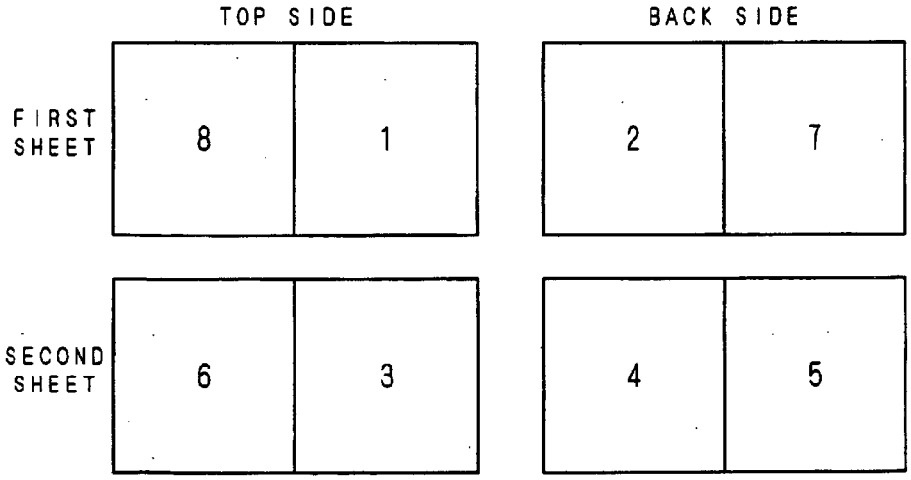
FIG. 10 is a diagram to explain imposition in the case of saddle stitching.

FIGS. 9 and 10 are diagrams to explain imposition that the sequence determination part 174 performs on the basis of imposition information MJ. FIG. 9 shows imposition when the number of pages is "8", the number of folding is "1", and the stitching conditions are "right" and "side stitching". Because the number of folding is "1", the number of folding to a single sheet is "1" and the number of pages aligned on the sheet is a total of four pages on both sides of the sheet. Since the number of pages is "8", two sheets are required for printing eight pages. Since the stitching conditions are "right" and "side stitching", four pages are printed by arranging page 4 and page 1 on the top side of a first sheet while page 2 and page 3 on the back side, and the remaining pages, page 5, page 6, page 7 and page 8, are arranged and printed on a second sheet, as shown in FIG. 9.

On the other hand, FIG. 10 shows imposition when the number of pages is "8", the folding number is "1", and the stitching conditions are "right" and "saddle stitching". In FIG. 10, since the number of pages and the number of folding are the same as the example in FIG. 9, the number of folding, the number of pages to be imposed on a single sheet, and the number of sheets required are the same as in FIG. 9.

However, since the stitching method is "saddle stitching," the arrangement of pages is different from that of FIG. 9. That is, as shown in FIG. 10, page 8 that is the last page, and page 1 that is the first page are printed on the top side of the first sheet, while page 2 that is the next page of page 1, and page 7 that is the previous page of page 8 are printed on the back side of the first sheet. On the other sheet (second sheet), the remaining pages, page 3, page 4, page 5 and page 6, are arranged and printed as shown in FIG. 9.

Figure 11:
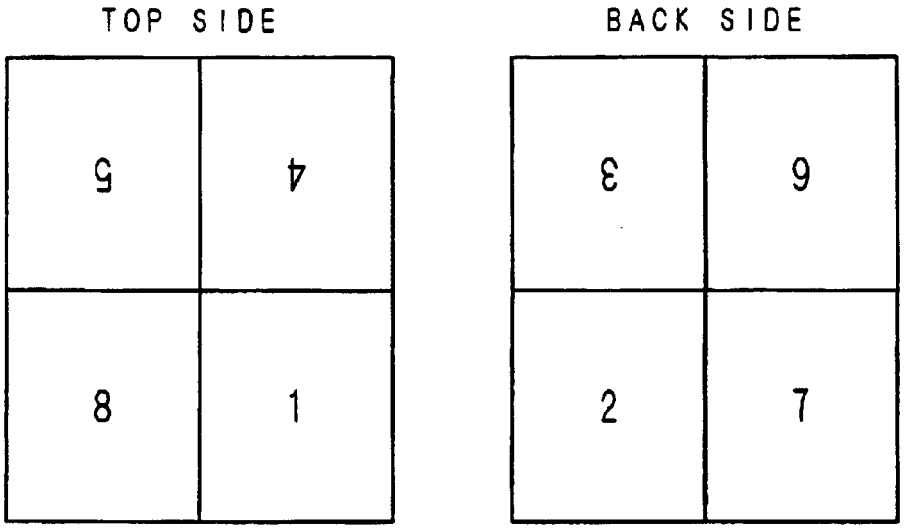
FIG. 11 is a diagram to explain the case of imposing eight pages on a sheet.
Figure 12:
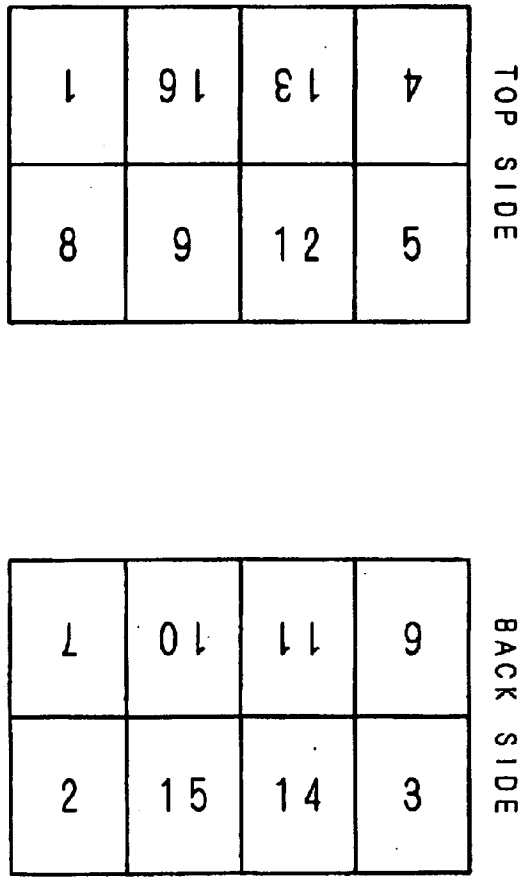
FIG. 12 is a diagram to explain the case of imposing eleven pages on a sheet.

Since such imposition is executed on the basis of a predetermined pattern, the sequence determination part 174 can impose printing data RPD of a multiple of "4" to a single sheet by storing a plurality of imposition patterns. For example, as shown in FIG. 11, eight printing data RPD may be imposed so as to perform printing of a total of eight pages, four pages each on the top side and back side of a single sheet. Alternatively, as shown in FIG. 12, 16 printing data RPD may be imposed so as to perform printing of a total of 16 pages, eight pages each on the top side and back side of a single sheet.

Figures 13, 14:
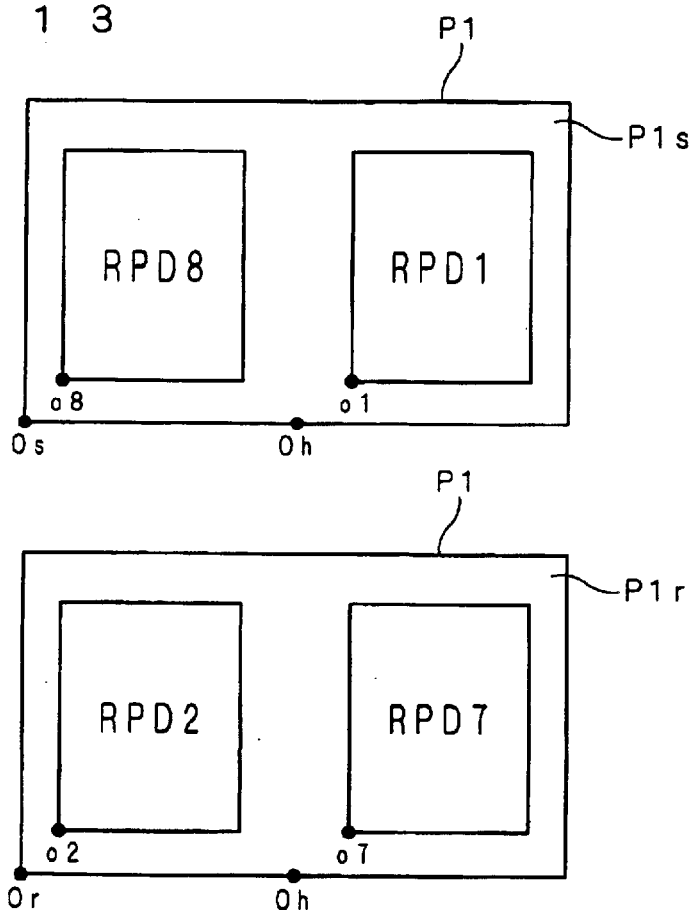
FIG. 13 is a diagram showing how printing data RPD is imposed on the basis of the imposition information MJ in FIG. 8.
FIG. 14 is a diagram showing the configuration of imposed printing data MRPD.

FIG. 13 illustrates such a state that printing images represented by printing data RPD1, RPD2, RPD7 and RPD8 are arranged on sheet P1 on the basis of the setting of the imposition information MJ shown in FIG. 8. As illustrated, printing images represented by printing data RPD8 and RPD1 are printed on the top side P1*s* of sheet P1, and printing images represented by printing data RPD2 and RPD7 are printed on the back side P1*r*. The printing image of printing data RPD8 is arranged such that the lower left corner o8 of the printing image is located at a position that is located at an offset value of "5 mm, 5 mm" from the lower left corner Os of top side P1*s*. On the other hand, the printing image of printing data RPD1 is arranged such that the lower left corner o1 of the printing image is located at a position that is located at an offset value of "5 mm, 5 mm" from a midpoint Oh of sheet P1. The reason for this is as follows. Since sheet P1 is not subjected to any folding, the offset position of the printing image represented by the printing data RPD1 is determined by an offset value taking, as an origin, a location at which a folding is performed.

Likewise, on the back side P1*r* of sheet P1, the printing image represented by the printing data RPD2 is arranged at a position designated by an offset value from the lower left corner Or of back side P1*r*, and the printing image represented by the printing data RPD7 is arranged at a position designated by an offset value from the midpoint Oh of sheet P1. Like sheet P1, printing images represented by their respective printing data RPD3, RPD4, RPD5 and RPD6 are arranged on sheet P2.

As the result, the sequence determination part 174 creates imposed printing data MRPD as shown in FIG. 14. As illustrated, each of the imposed printing data MRPD is composed of a plurality of printing data RPD (two printing data RPD in the example of FIG. 14) in order to perform printing on each of the top side P1*s* and back side P1*r* of sheet P1, and each of the top side P2*s* and back side P2*r* of sheet P2.

Imposed printing data MRPD1 contains the printing data RPD8 and RPD1, as well as their respective offset values. Here, the offset value of the printing data RPD1 is the sum of an X value of the offset value set by the imposition information MJ and an X axis coordinate value of the midpoint Oh, because the position is designated from the midpoint Oh of sheet P1. Accordingly, the printing data RPD7, RPD3 and RPD5 for representing the printing images arranged on the right of the sheet shown in FIG. 13 have respective changed offset values.

Thus, the individual imposed printing data MRPD created by the sequence determination part 174 are temporarily stored in the printing data storage part 171.

Further, based on the bookbinding apparatus setting information SJ stored in the information capture part 172, the sequence determination part 174 determines the sequence of output of the imposed printing data MRPD with respect to the printing apparatus 2. Specifically, the sequence determination part 174 determines the sequence of output of the imposed printing data MRPD, depending on the "sequence of pickup" and "state of pickup" about a sheet pickup manner in the bookbinding part 22, which are captured as bookbinding apparatus setting information SJ.

As described previously, the printing part 21 stacks sheets such that a later printed sheet is stacked on an earlier printed sheet. Therefore, as a first step of determining the sequence of output, the sequence determination part 174 determines temporarily the sequence of output of imposed printing data MRPD, depending on whether the sequence of pickup of sheets in the bookbinding part 22 is "the uppermost position" or "the lowermost position." The following is an explanation with the aid of the specific example in FIG. 13.

(I) In the case that the bookbinding part 22 picks up sheets by "the uppermost position" in its bookbinding process:

In this case, the printing part 21 is required to print finally the imposed printing data MRPD1 and print firstly the imposed printing data MRPD4. Therefore, the sequence determination part 174 determines temporarily the sequence of output of the imposed printing data MRPD1 to MRPDn (n is a positive integer and even number) as follows: MRPDn, MRPDn−1, . . . MRPD2 and MRPD1. That is, the sequence of output of the imposed printing data MRPD is descending order.

(II) In the case that the bookbinding part 22 picks up sheets by "the lowermost position":

In this case, the printing part 21 is required to print firstly the imposed printing data MRPD1 and print finally the imposed printing data MRPD4. Therefore, the sequence determination part 174 determines temporarily the sequence of output of the imposed printing data MRPD1 to MRPDn (n is a positive integer and even number) as follows: MRPD1, MRPD2, . . . MRPDn−1 and MRPDn. That is, the sequence of output of the imposed printing data MRPD is ascending order.

Thus, the sequence determination part 174 determines temporarily the sequence of output of the imposed printing data MRPD, and the first step in the process of determining the sequence of output is completed.

Subsequently, the sequence determination part 174 subjects the sequence of output determined temporarily to a second step in which the sequence of output of the imposed printing data MRPD is finally determined.

The printing part 21 stacks sheets such that in two imposed printing data MRPD to be printed on a single sheet, the printing image of a preceding printed imposed printing data MRPD underlies the printing image of a succeeding printed imposed printing data MRPD. Therefore, the sequence determination part 174 adjusts, as the second step, the sequence of output of the two imposed printing data MRPD to be printed on the same sheet, depending on whether the sheet pickup state in the bookbinding part 22 is "face up" or "face down."

More specifically, (I-A) In the case that the bookbinding part 22 picks up sheets by "the uppermost position" and "face up" in its bookbinding process:

FIG. 15 illustrates a state of stacked sheets required in this case and imposed printing data MRPD printed on individual sides of the stacked sheets. In this case, a sheet with the imposed printing data MRPD1 printed thereon is located at the uppermost position of the stacked sheets and one side with the imposed printing data MRPD1 printed thereon is facing up. Therefore, the sequence of output of two imposed printing data MRPD to be printed on the same sheet is "first even number, then odd number" (descending order), and the sequence determination part 174 determines the sequence of output of the imposed printing data as follows: MRPDn, MRPDn−1, . . . MRPD2 and MRPD1 (n is a positive integer and even number).

(I-B) In the case that the bookbinding part 22 picks up sheets by "the uppermost position" and "face down" in its bookbinding process:

FIG. 16 illustrates a state of stacked sheets required in this case and imposed printing data MRPD printed on individual sides of the stacked sheets. In this case, a sheet with the imposed printing data MRPD1 printed thereon is located at the uppermost position of the stacked sheets, and its one side with the imposed printing data MRPD1 printed thereon is facing down. Therefore, the sequence determination part 174 adjusts the sequence of output of two imposed printing data MRPD to be printed on the same sheet to "first odd number, then even number" (ascending order), and determines the sequence of output of the imposed printing data as follows: MRPDn−1, MRPDn, . . . MRPD1 and MRPD2 (n is a positive integer and even number).

On the other hand, (II-A) In the case that the bookbinding part 22 picks up sheets by "the lowermost position" and "face down" in its bookbinding process:

FIG. 17 illustrates a state of stacked sheets required in this case and imposed printing data MRPD printed on individual sides of the stacked sheets. In this case, a sheet with the imposed printing data MRPD1 printed thereon is located at the lowermost position of the stacked sheets, and its one side with the imposed printing data MRPD1 printed thereon is facing down. Therefore, the sequence of output of two imposed printing data MRPD to be printed on the same sheet is "first odd number, then even number" (ascending order), and the sequence determination part 174 determines the sequence of output of the imposed printing data as follows: MRPD1, MRPD2, . . . MRPDn−1 and MRPDn (n is a positive integer and even number).

(II-B) In the case that the bookbinding part 22 picks up sheets by "the lowermost position" and "face up" in its bookbinding process:

FIG. 18 illustrates a state of stacked sheets required in this case and imposed printing data MRPD printed on individual sides of the stacked sheets. In this case, a sheet with the imposed printing data MRPD1 printed thereon is located at the lowermost position of the stacked sheets, and its one side with the imposed printing data MRPD1 printed thereon is facing up. Therefore, the sequence determination part 174 adjusts the sequence of output of two imposed printing data MRPD to be printed on the same sheet to "first even number, then odd number" (descending order), and determines the sequence of output of the imposed printing data as follows: MRPD2, MRPD1, . . . MRPDn and MRPDn−1 (n is a positive integer and even number).

Thus, the sequence determination part 174 determines the sequence of output of the imposed printing data MRPD from the bookbinding apparatus setting information SJ. FIG. 19 is an imposed-printing-data output sequence table (hereinafter simply referred to as "output sequence table") OPS in the case (I-A). The output sequence table OPS shows the relationship between the sequence of output (a sequence of printing) determined by the sequence determination part 174 and the imposed printing data MRPD. This table is stored in the sequence determination part 174. The controller 1 outputs the imposed printed data MRPD in a process to be described later, on the basis of the output sequence table OPS shown in FIG. 19.

In step S5, the output part 175 reads out a plurality of imposed printing data MRPD stored in the printing data storage part 171 and then sends them in the sequence of output shown on the output sequence table OPS to the printing apparatus 2 via the communication line CL.

Alternatively, while reading out a plurality of imposed printing data MRPD stored in the printing data storage part 171 in the sequence of output shown on the output sequence table OPS, the output part 175 may send them sequentially to the printing apparatus 2. At this time, the controller 1 sends imposition information MJ to the printing apparatus 2.

In step S6, the printing part 21 of the printing apparatus 2 prints on a sheet imposed printing data MRPD in the sequence received. When perfecting is set in the imposition information MJ received from the controller 1, the printing part 21 of the printing apparatus 2 executes perfecting process.

The bookbinding part 22 performs bookbinding process by picking up the sheets that are printed and then stacked in the printing part 21. The bookbinding part 22 executes the binding of sheets in accordance with the stitching and folding conditions set in the imposition information MJ sent to the printing apparatus 2.

Thus, the printing system 100 of FIG. 1 operates as illustrated in the flowchart of FIG. 2. This enables to provide the printing system that does not require any operator to have the skill of imposing in consideration of a pickup manner in a bookbinding apparatus.

Firstly, although the foregoing description is made on the assumption that a total of four pages are imposed on both sides of a single sheet, the present invention is also applicable to the case of imposing pages of a multiple of "4", such as a total of 8 pages, 16 pages and 32 pages, on both sides of a single sheet.

Secondly, although the foregoing description is made on the assumption that the bookbinding part 22 picks up sheets that are printed and then stacked by the printing part 21, the present invention is also applicable to the case where the bookbinding part 22 picks up one by one the sheets printed by the printing part 21.

Thirdly, although the foregoing description is made on the assumption that the printing apparatus 2 has the bookbinding part 22, the present invention is also applicable even when the bookbinding part 22 is placed at a location remote from the printing apparatus 2.

Fourthly, although the foregoing description is made on the assumption that the controller 1 and printing apparatus 2 are separated with each other, the present invention is also applicable even when the controller 1 and printing apparatus 2 are integral with each other.

Lastly, although the foregoing description is made on the assumption that imposed printing data MRPD are printed by the printing part 21, the present invention is also applicable to the case where printing data RPD are printed by the printing part 21.

While the invention has been shown and described in detail, the foregoing description is in all aspects illustrative and not restrictive. It is therefore understood that numerous modifications and variations can be devised without departing from the scope of the invention.

What is claimed is:

1. A printing system comprising:

(a) a printing apparatus to print on sheets imposed printing data in which printing data are imposed;

(b) a bookbinding apparatus that is coupled to said printing apparatus and binds sheets on which said imposed printing data are printed by said printing apparatus; and (c) a controller to supply said imposed printing data to said printing apparatus, said controller comprising (c-1) a storage element to store printing data;

(c-2) an information capture element to capture information from said bookbinding apparatus about the orientation of and a sequence of capture of sheets when said bookbinding apparatus captures said sheets, as a bookbinding apparatus setting information;

(c-3) a setting element to set information for imposing on sheets said printing data stored in said storage element, as an imposition information;

(c-4) a sequence determination element that creates said imposed printing data on the basis of said printing data while referring to said bookbinding apparatus setting information captured by said information capture element and said imposition information set by said setting element, and that determines a sequence of output of said imposed printing data so created; and (c-5) an output element to output said imposed printing data to said printing apparatus in said sequence determined by said sequence determination element, whereby said printing apparatus prints on said sheets said imposed printing data in a sequence outputted by said output element, and then supplies said sheets to said bookbinding apparatus.

2. The printing system according to claim 1, wherein said sequence determination element determines a sequence of output of said imposed printing data on the basis of a direction of opening set by said setting element.

3. The printing system according to claim 1, wherein said sequence determination element determines a sequence of output of said imposed printing data on the basis of a stitching method set by said setting element.

4. A controller of a printing system having a printing apparatus to which a bookbinding apparatus is connected, said controller comprising:

(a) a storage element to store printing data;

(b) an information capture element to capture information from said bookbinding apparatus about the orientation of and a sequence of capture of sheets when said bookbinding apparatus captures said sheets, as a bookbinding apparatus setting information;

(c) a setting element to set information for imposing on sheets said printing data stored in said storage element, as an imposition information;

(d) a sequence determination element that creates imposed printing data on the basis of said printing data while referring to said bookbinding apparatus setting information captured by said information capture element and said imposition information set by said setting element, and that determines a sequence of output of said imposed printing data so created; and (e) an output element to output said imposed printing data to said printing apparatus in said sequence of output determined by said sequence determination element.

5. A printing method comprising:

(a) a storage step of storing printing data;

(b) an information capture step of capturing information from a bookbinding apparatus coupled to a printing apparatus about the orientation of and a sequence of capture of sheets when said bookbinding apparatus captures said sheets, as a bookbinding apparatus setting information;

(c) a setting step of setting information about imposition of said printing data stored in said storage step, as an imposition information;

(d) a creation step of creating imposed printing data in which said printing data are imposed, on the basis of said printing data while referring to said bookbinding apparatus setting information captured in said information capture step and said imposition information set in said setting step;

(e) a sequence determination step of determining a sequence in which said imposed printing data created in said creation step are outputted to said printing apparatus;

(f) a printing step of printing on sheets printing images represented by said imposed printing data in said sequence determined in said sequence determination step; and (g) a supply step of supplying said sheets after being subjected to printing in said printing step, to said bookbinding apparatus.

6. A storage medium storing a program readable by a computer, the execution of said program by said computer causing said computer to execute the followings:

(a) a storage step of storing printing data;

(b) an information capture step of capturing information from a bookbinding apparatus coupled to a printing apparatus about the orientation of and a sequence of capture of sheets when said bookbinding apparatus captures said sheets, as a bookbinding apparatus setting information;

(c) a setting step of setting information about imposition of said printing data stored in said storage step, as an imposition information;

(d) a creation step of creating imposed printing data in which said printing data are imposed, on the basis of said printing data while referring to said bookbinding apparatus setting information captured in said information capture step and said imposition information set in said setting step;

(e) a sequence determination step of determining a sequence of output of said imposed printing data created in said creation step; and (f) an output step of outputting said imposed printing data to said printing apparatus in said sequence determined in said sequence determination step.

* * * * *